United States Patent [19]

Andersen et al.

[11] 4,444,548

[45] Apr. 24, 1984

[54] SUCTION APPARATUS

[75] Inventors: Harold W. Andersen; Charles H. Harrison, both of Oyster Bay; Melvin H. Worth, Jr., Staten Island, all of N.Y.

[73] Assignee: University Testing Service Inc., Oyster Bay, N.Y.

[21] Appl. No.: 176,387

[22] Filed: Aug. 8, 1980

[51] Int. Cl.[3] ..... F04B 21/00

[52] U.S. Cl. ..... 417/63; 15/339; 15/353; 417/148; 417/234; 417/413

[58] Field of Search ..... 128/276, 278, 275; 417/412, 413, 148, 120, 234, 63, 148; 15/339, 353, 321, 420; 73/427; 137/575, 582

[56] References Cited

U.S. PATENT DOCUMENTS

| | | | |
|---|---|---|---|
| 3,169,843 | 2/1965 | Campbell | 15/420 X |
| 3,199,745 | 8/1965 | Hollis et al. | 417/234 X |
| 3,223,041 | 12/1965 | Quinn | 417/36 X |
| 3,319,578 | 5/1967 | Ware | 417/148 |
| 3,429,313 | 2/1969 | Romanelli | 128/276 |
| 3,545,894 | 12/1970 | Lovitz | 417/412 |
| 3,782,414 | 1/1974 | Holbrook | 73/427 X |
| 3,871,377 | 3/1975 | Treace | 128/278 |
| 4,008,717 | 2/1977 | Kowarski | 128/278 X |
| 4,112,949 | 9/1978 | Rosenthal et al. | 128/278 |
| 4,265,118 | 5/1981 | Griesel | 73/427 |

*Primary Examiner*—Edward K. Look

*Attorney, Agent, or Firm*—Jordan and Hamburg

[57] ABSTRACT

Suction apparatus for use in draining fluids from operative wounds or other body cavities includes a housing having a vacuum chamber, at least a portion of which serves as a storage compartment for aspirated fluids. A vacuum pump in the apparatus has an inlet in communication with the vacuum chamber for providing a vacuum therein. The storage compartment has an inlet for introducing aspirated fluid therein, and an outlet is provided for emptying fluid from the compartment. Suitable means are provided on the compartment for measuring the quantity of aspirated fluid collected in the storage compartment.

17 Claims, 4 Drawing Figures

SUCTION APPARATUS

BACKGROUND OF THE INVENTION

This invention related to suction pump apparatus and more particularly to vacuum pump apparatus in the form of a unitary assembly which provides the required vacuum, along with storage and measurement of aspirated fluid. The apparatus of the invention is useful in connection with the aspiration of fluids from humans, for example, in draining of fluids from operative wounds and the aspiration of gastrointestinal secretions.

Accordingly, an object of the present invention is to provide suction pump apparatus which can be connected operatively with a wound drain or other drainage tube for the drainage of fluid from a wound or body cavity which is in the form of a unitary assembly and is capable of providing the required vacuum, storage, and measurement of accumulated aspirated fluid.

Another object of this invention is to provide suction pump apparatus of the character described which is easily manufactured and assembled.

A further object of this invention is the provision of suction pump apparatus of the character described which, when in use, can be conveniently mounted on a bed rail or stand where the quantity of fluid aspirated may be readily monitored and viewed and fluids emptied as desired from the apparatus without need for interruption of the drainage procedure.

Other objects and advantages of the invention will become readily apparent to persons versed in the art to which the invention pertains from the ensuing description.

DESCRIPTION OF THE PREFERRED EMBODIMENTS

Figure 1:
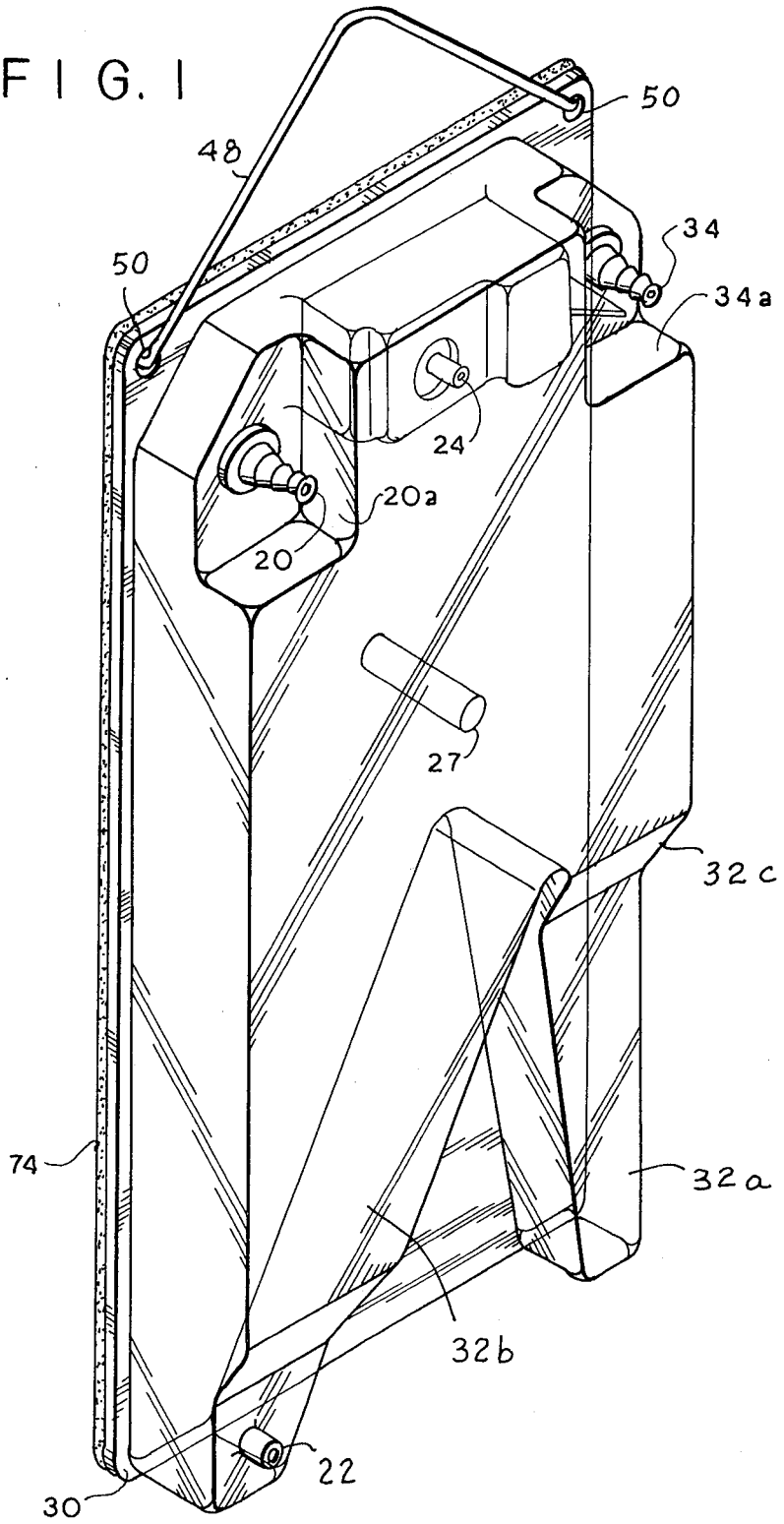
FIG. 1 is a perspective view of a suction pump apparatus according to one embodiment of the present invention.

Before explaining the invention in detail, it is to be understood that the invention is not limited in its application to the details of construction and arrangement of parts illustrated in the drawings since the invention is capable of other embodiments and of being practical or carried out in various ways. It is also to be understood that the phraseology or terminology employed is for the purpose of description only and not of limitation.

Referring to the drawings, the suction pump apparatus according to one embodiment comprises a housing having a closure member 12 and a base member 14. Both of such members 14 and 12 may be fabricated desirably from a synthetic plastic material which need not be the same material. Preferably, the closure member 12 is formed of a clear transparent material so that the interior of the apparatus is visually observable. In this manner, as will become evident, the quantity of accumulated fluid within the storage region can be readily ascertained and measured. The closure member 12 is fabricated so as to be imperforate and thereby prevent the leakage of air and/or aspirated fluid therefrom. The base member 14 is also imperforate except for provision of an opening 24 therein permitting communication between a vacuum pump (described hereinafter) and a chamber 26 defined between the closure member 12 and the base member 14.

The base member 14 is formed with a continuous groove 28 which extends thereabout in conformity with the peripherally extending edge 30 of the closure member 12. The depth and width of the groove 28 is selected so that the closure member 12 may be positioned upon the base member 14 and seated within the groove 28 to sealingly connect the base and closure members. Prior to such positioning of the closure member 12 upon te base member 14 an adhesive composition is deposited either within groove 28 or on edge 30 to ensure sealing of the joint therebetween. Further, the edge and groove may be so configured and dimensioned to allow a force fit therebetween to assure a sealing relationship between the base and closure members. Further, the possibility of other sealing methods are envisioned such as by ultra sound, and radio frequency energy.

The closure member 12 may be formed with an integral stud or support 27 extending down to the base member 14 to provide a structural support at the central portion of the vacuum chamber 26.

When the closure member 12 is positioned upon base member 14 the previously mentioned vacuum chamber 26 is defined therebetween. The vacuum chamber 26 initially is constituted by the interior region defined by the joint formed between the engaging groove 28 and edge 30 of the base and closure members 14, 12.

Figure 3:
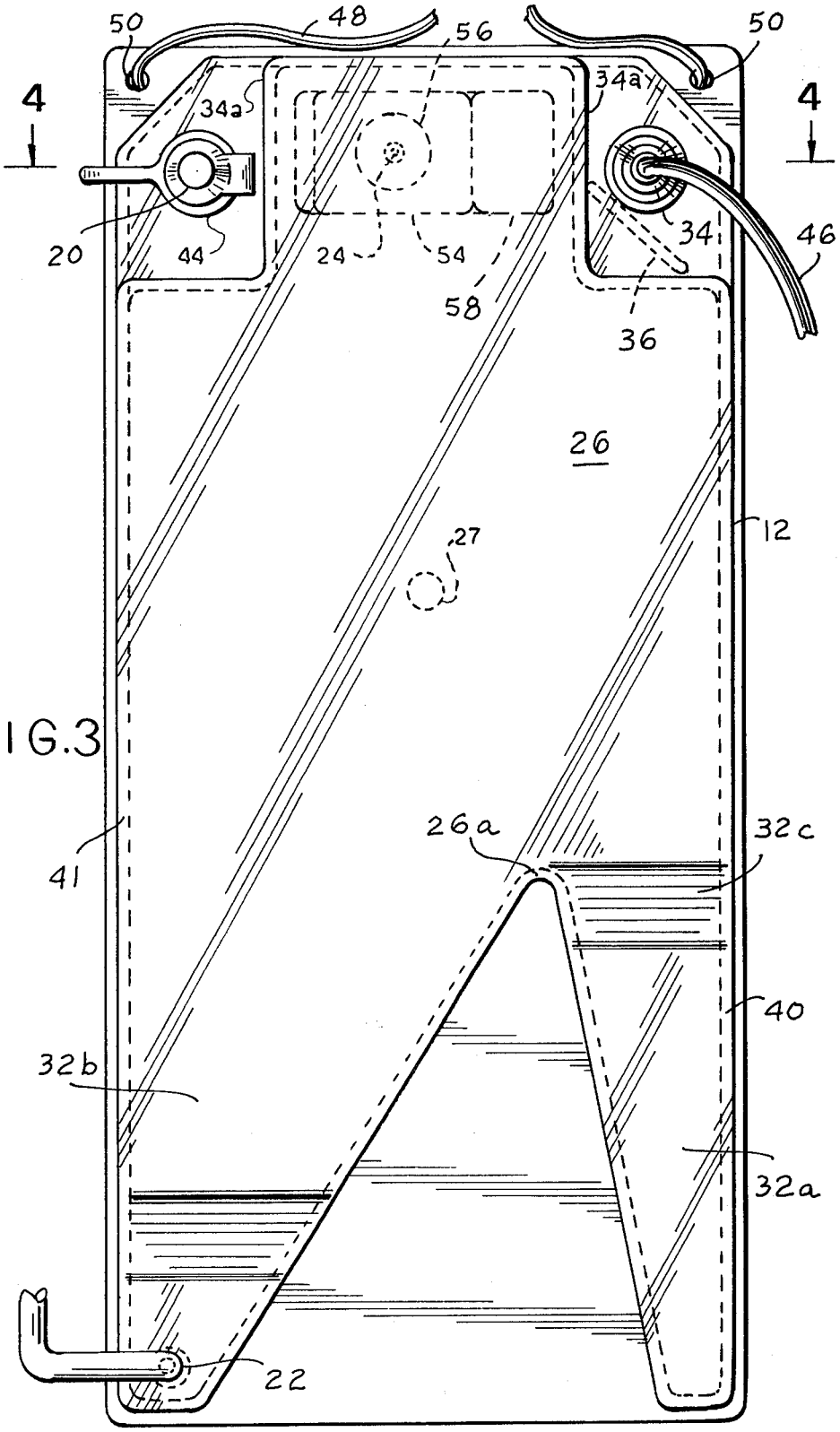
FIG. 3 is a plan view of the suction pump apparatus shown in FIG. 1.

At one upper corner of the closure member 12 there is formed an inlet 34. When the closure member 12 is fabricated of a synthetic plastic material by a molding procedure, it may be expeditious to form the inlet 34 as an integral short tube-like extension to which one end of an inlet drainage tube may be connected or alternatively to assemble such means as a separate operation. The inlet 34 may have stepped rings as illustrated in FIGS. 1 and 3 to facilitate connection to a drainage tube or, alteratively, inlet 34 may be straight-walled or tapered as desired. An auxiliary inlet 20 may also be formed in closure member 12 and is substantially of the same construction as inlet 34 already described. The inlets 34 and 20 are formed on and extend from recesses formed in the corners of the closure member 12. Both inlets 34 and 20 have internal passages communicating with the inside of vacuum chamber 26. Further, inlet 34 may be provided with a means to prevent retrograde flow such as a thin membrane like valve 81 which provides for fluid flow only into chamber 26.

As shown in FIG. 3, the vacuum chamber 26 is configured to define an upper section and a pair of lower tapered sections **32*a* and 32*b* which are in open communication with and extend from the upper section. In use, both tapered sections 32*a* and 32*b* comprise storage compartments for aspirated fluid as will be further described. The tapered sections 32*a*, 32*b* become narrower towards the bottom ends thereof remote from the inlet 34. Although sections 32*a*, 32*b* both openly communicate at their upper ends with the upper section of chamber 26, they extend towards the bottom ends thereof in spaced relation and do not communicate with each other except through the common upper portion 26*a* of chamber 26. Further, the volumetric capacity of section 32*a* is less than that of section 32*b* thereby enabling compartment 32*a* to be employed for the initial accumulation of relatively small measurable quantities of aspirated fluid. In order to ensure that in such instances the aspirated fluid entering inlet 34 will be directed into compartment 32***a*, a baffle member 36 is provided interiorly of the closure member 12, desirably as an integral part thereof, in longitudinal alignment with compartment 32*a* and just below the inlet 34. When the apparatus is suspended such as from a bed rail 38 as shown in FIG. 1, fluid entering inlet 34 will impinge upon baffle member 36 and will descend into underlying compartment 32*a*. In this regard, the right hand end of the baffle member 36 (as shown in FIG. 3) is spaced from the wall of the closure member 16 to thereby provide a clearance passage for the fluid to flow therethrough to the underlying section 32*a*.

Graduated scales 40, 41 are desirably affixed to either base member 14 or closure member 12 so as to extend along the length of both of sections 32*a*, 32*b* and be easily visible to indicate the quantity of fluid which has accumulated within such sections. It will be appreciated, of course, that separate scales 40, 41 are provided for each of such sections 32*a*, 32*b*. Each of such scales 40, 41 is provided with calibrations which correspond to the change in volume of the respective section 32*a* or 32*b*, the calibrations being different for each section due to the different volumetric capacity of each section 32*a*, 32*b* per linear unit of measurement. It will be observed that sections 32*a* will first fill up with fluid, and then after it is full, the fluid will spill over at 26*a* into section 32*b*.

Referring further to FIG. 3, it will be observed that an outlet port 22 is formed in closure member 12 at the bottom end portion of section 32*b*. If desired, another outlet port (not shown) may be formed in the closure member at the corresponding end of section 32*a*. By virtue of outlet port 22, fluids can be drained from compartment 32*b* and, if a similar port is formed at the corresponding end of compartment 32*a*, fluid can be drained separately from each of such compartments. It is further understood that small amounts collected measurably in 32*a* may be transferred to 32*b* by temporary mechanical transverse longitudinal realignment or tipping to cause fluid flow from 32*a* to 32*b* or reverse. Closure caps comprising a mounting ring 42 connected to a cover 44 may be provided for each of the ports 34, 20 and 22. Removal of the cover 44 of the closure cap enables connection of appropriate tubing 46 thereto. Corner indentations 34*a*, 20*a* and 22*a* are formed in 3 corners of the closure member 12 and the fittings for the ports 34, 20 and 22 are accommodated in such corner indentations 34*a*, 20*a* and 22*a* respectively.

Means such as a lanyard 48 are provided for supporting the apparatus on an external support surface when the apparatus is placed in use. In the illustrated form of the invention, a pair of apertures 50 are formed at the end of the base member 14. The lanyard 48 is threaded in such apertures and can be supported, for example, on a hook element 52 of a bed rail or support stand.

Figure 4:
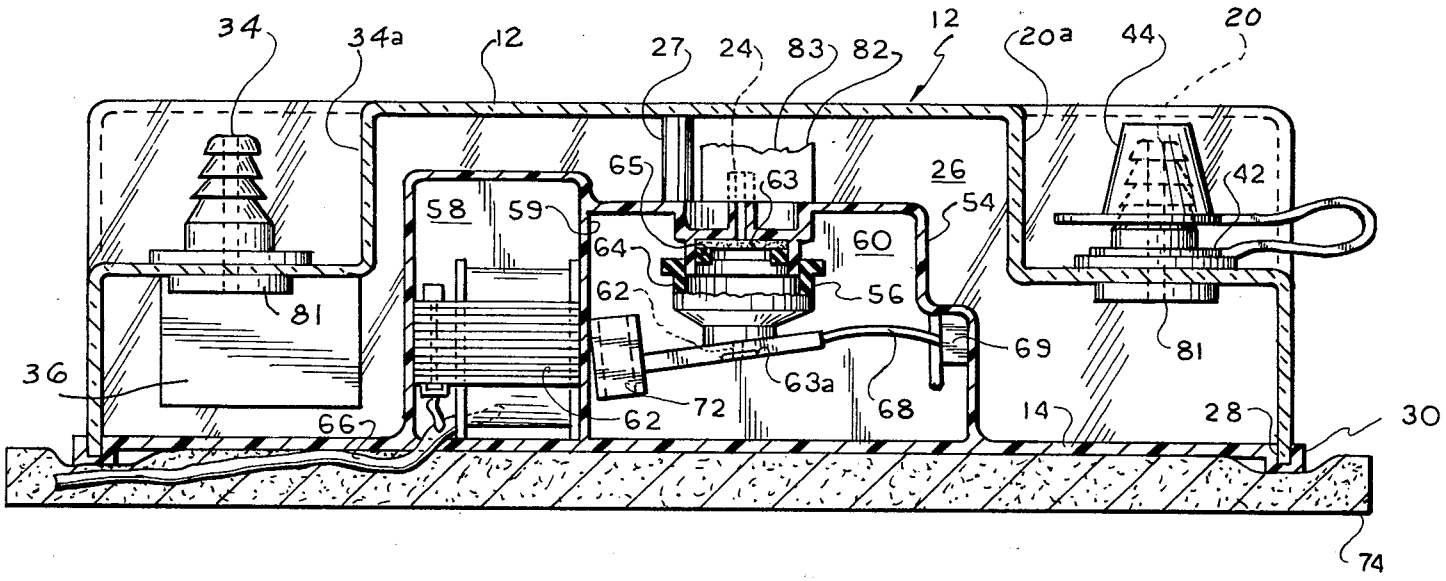
FIG. 4 is a cross-sectional view of the suction pump apparatus taken along the line 4—4 in FIG. 3.

Referring to FIGS. 3 and 4, there is shown a secondary housing 54 within which a vacuum pump 56 is positioned. Such housing 54 is integral with base member 14 and projects upwardly therefrom at the end of the apparatus. Thus the housing 54 is formed as an indentation in the base member 14 and has two sections 58, 60 separated by a wall member 59 integral with the base member 14. The two sections 58, 60 are open at the side of the base member 14 opposite to the chamber 26.

As shown in FIG. 3, an electromagnetic coil 62 is positioned within section 58 and a diaphragm-type pump 56 is located within section 60. The electromagnetic coil 62 is energizable by a source of alternating current (not shown) to which the coil 62 may be connected by means of an electric power cord 66. A flexible lever arm 68 on the diaphragm pump is fixed at 69 to the housing and is pivotable or flexible at such fixed end 69. A permanent magnet 72 at the free end of lever arm 68 is suspended within the field of the coil 62 and is caused to pivot or vibrate back and forth due to coil field oscillations of coil 62, thereby powering the diaphragm pump 56.

Housing 54 is provided with the opening 24 which communicates the inlet side of the diaphragm pump 56 with the inside of the vacuum chamber 26. In such manner the diaphragm pump 56 creates the desired vacuum pressure within the vacuum chamber 26 as is necessary to aspirate fluid from the selected internal cavity or wound of a human via the inlet 34 and tubing 46.

The diaphragm pump 56 comprises a flexible generally cup-shaped diaphragm 64 along with a suitable inlet valve 63 which may be in the form of a rubber strip of material disposed over the inlet 24 and held in place by a ring 65 suitably secured by adhesive or the like. Thus the downward movement of the diaphragm 64 (as viewed in FIG. 4) by the action of lever 68 which is connected to the bottom of the diaphragm 64 will draw a suction and thereby pull the rubber band inlet valve 63 away from the inlet 24 and draw in air from the vacuum chamber 26 through the inlet 24. When the diaphragm 64 moves upwardly (as viewed in FIG. 4), the pressure within the diaphragm 64 pushes the rubber strip inlet valve 63 against the inlet 24 to close the valve. A similar valve 63*a* is mounted on the lever 68 at the outlet of discharge passage 62 at the discharge side of the pump 64 and operates in the same manner but in opposition thereto so that when the inlet valve 63 opens, the discharge valve 63*a* closes and vice versa.

The inlet 24 is located at the upper portion of the vacuum chamber 26 and extends adjacent to but spaced from the closure member 12. Inlet 24 is provided with a filter 83 mounted in a support 82 such that all air which may be contaminated by bacteria from the aspirant in chamber 24 is passed through the filter. The filter 83 is structured to prevent passage of the bacteria and further will prevent passage of any liquid aspirant to the vacuum means.

Figure 2:
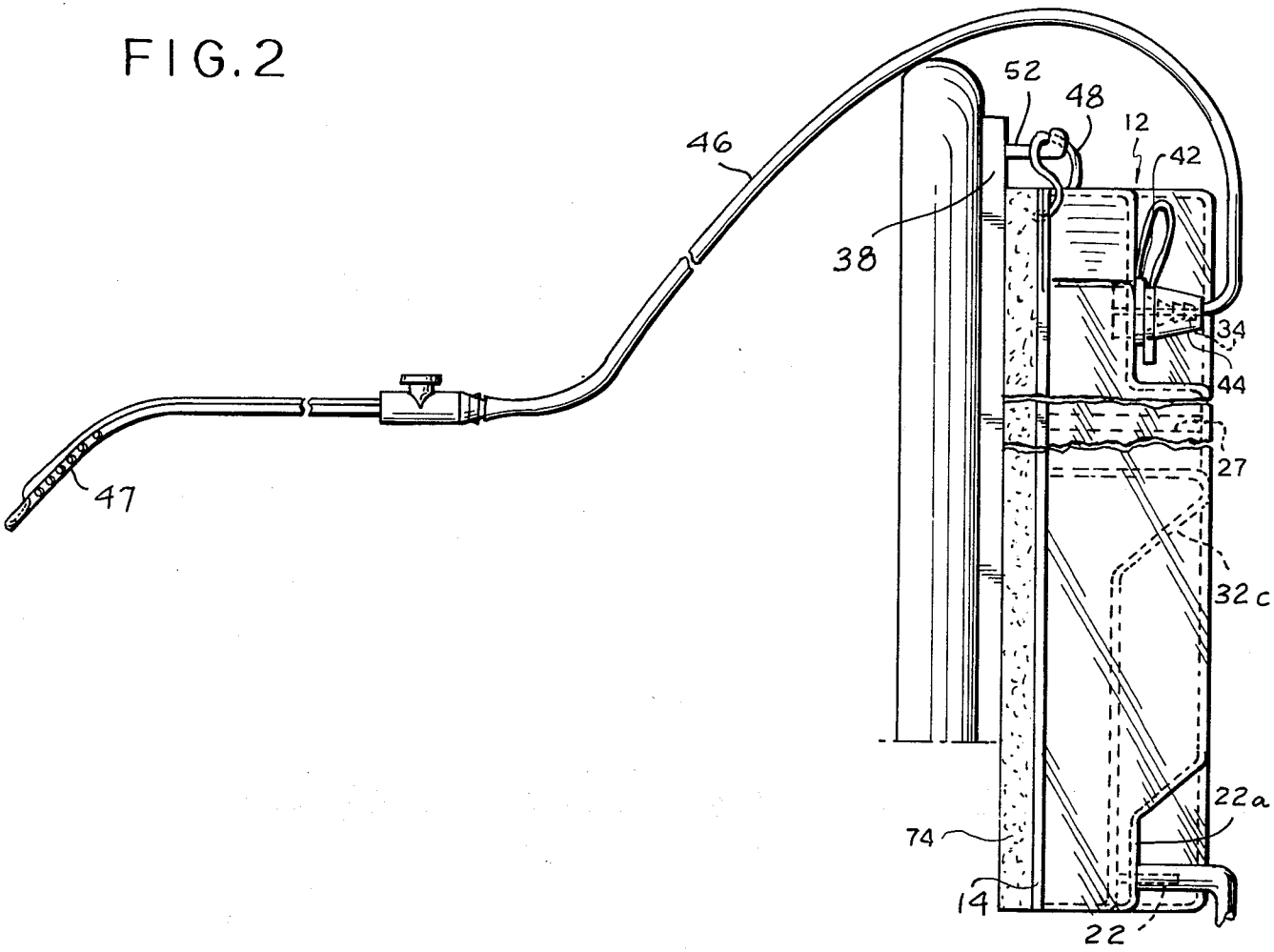
FIG. 2 is a side elevational view, partly broken away, of the suction pump apparatus shown in FIG. 1.

The apparatus may be operated when it is suspended vertically from an appropriate support member, or also it may be operated when disposed flat. When suspended, the sections 32*a* and 32*b* extend substantially vertically as shown in FIG. 3. The section 32*a* is narrower and contains less volumetric capacity than section 32*b*. This will be apparent by comparing sections 32*a* and 32*b* in FIG. 3. Section 32*a* is also narrower than 32*b* in a direction perpendicular to the paper as viewed in FIG. 3. Thus section 32*a* has a short sloping portion 32*c* which provides the transition from the deeper main section of compartment 26 to the shallower lower section of section 32*a*. This transition 32*c* is shown in FIGS. 1 and 2.

When the apparatus is suspended with the section 32*a* and 32*b* extending generally vertically, as shown in FIG. 3 the aspirated fluid will flow from the body cavity through tubing 46 to inlet 34 and fall directly into the section 32*a*. The previous mentioned baffle 36 ensures that the fluid will fall into section 32*a*. Thus as section 32*a* gradually fills up, the volumetric capacity may be readily measured and observed by the scale 40. Since, as previously indicated, section 32*a* has a relatively small volumetric capacity, accurate measurement of small quantities can be discerned.

As section 32*a* fills up, the fluid will pass over the top at 26*a* and then start to fill up section 32*b*. As 32*b* fills up, then the fluid can start filling the upper portion of the main chamber 26. Here again, the scale 41 may be provided to monitor the volumetric capacity as the section 32*b* and also the main upper portion of the chamber 26 as the latter also fills up.

It will be seen that since the inlet 24 is located at the upper portion of the apparatus, that the entire vacuum chamber 26 could be almost completey filled before the aspirated liquid would reach the level of the inlet 24.

Although the apparatus has been described as being vertically disposed, it may also be disposed so that the base 14 lies flat on a horizontal surface. The device will still operate although the measuring scales 40, 41 would not be applicable. In this regard, the opening of the inlet 24 extends close to the upper portion of the closure member 16 so that fluid will not pass into the inlet 24 until the chamber 26 is almost completely filled to the top.

It will also be observed that the liquid may be drained from the section 32*b* through the outlet 22 as may be desired. The outlet 22 may be provided with a removable cap to facilitate emptying of the container.

The auxiliary suction inlet 20 is provided to connect the unit to an auxiliary source of suction as may be desired.

The drainage tube 46 is attached to the inlet 34 and a known bacterial filter (not shown) may be mounted thereon. A wound drain 47 would then be attached to the end of the connector. In use, the wound drain 47 would be inserted into a surgical incision to remove oozing and seeping blood from an operative wound before it has time to clot. The apparatus may also be connected to other drainage tubes such as a gastrointestinal sump tube assembly or the like, for example, of the type disclosed in H. W. Andersen U.S. Pat. Nos. 3,114,373 and 3,189,031.

The inlet 34 may be provided with a non-reflux valve 81 so as to prevent passing of any fluid from the apparatus in a reverse direction, for example in the event of a failure of the diaphragm pump. Such non-reflux valve may, if desired, be soldered, welded or otherwise secured to the inlet 34.

It will be further understood that after positioning of the electromagnetic coil 62 in the compartment 58, that the coil itself could be completely encapsulated in a suitable compound, such as an epoxy type material. Also a suitable cover (not shown) could generally be placed over the recesses 58 and 60. A foam material 74 could be adhesively secured to the exposed face of the base member 14 to reduce vibrationally emitted sound.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. Suction pump apparatus comprising a housing having an imperforate base member and an imperforate closure member dimensioned and configured for superimposing upon said base member in sealing relationship therewith to define a vacuum chamber therebetween, said housing defining a vacuum chamber at least a portion of which serves as a storage compartment for aspirated fluid, said closure member being configured so as to define in combination with said base member a first larger vacuum chamber section and at least one second smaller vacuum chamber section communicating with and extending from said first chamber section, said second chamber section becoming narrower towards the end thereof remote from said first chamber section, an inlet in said housing for the introduction of aspirated fluid into said storage compartment, an outlet in said housing for the discharge of fluid therefrom, and a vacuum pump carried by said housing in communication with said vacuum chamber for maintaining a predetermined vacuum therein, whereby aspirated fluid is drawn into said storage compartment through said inlet.

2. Suction pump apparatus according to claim 1, comprising a pair of said second chamber sections spaced laterally from each other.

3. Suction pump apparatus according to claim 2, wherein said outlet is formed in said closure member at least in one of said second chamber sections adjacent said end thereof.

4. Suction pump apparatus according to claim 2, wherein one of said second chamber sections possesses a greater volume than the other of said second chamber sections.

5. Suction pump apparatus according to claim 1, wherein said closure member is provided with a baffle member adjacent said inlet, said inlet and baffle member being located in substantial alignment with one of said second chamber sections so as to direct fluid entering said vacuum chamber by means of said inlet into said second chamber sections aligned therewith.

6. Suction pump apparatus according to claim 1, inlcuding a graduated scale associated with at least one of said second chamber sections for indicating the quantity of accumulated fluid therein.

7. Suction pump apparatus comprising a housing structure defining a vacuum chamber, an inlet to said vacuum chamber for receiving aspirated fluid, an outlet on said vacuum chamber for discharging said fluid, said housing structure defining a substructure sealed from said vacuum chamber, vacuum pump means within said substructure, said vacuum pump means having an inlet communicating with said vacuum chamber, said vacuum chamber having a first chamber section and a second chamber section, said second chamber section having a smaller volumetric capacity than said first chamber section, said second chamber section being constructed and arranged to receive the aspirated fluid initially introduced into said vacuum chamber, thereby facilitating accurate measurement of small quantities of aspirated fluid initially introduced into said second chamber section, said housing structure having a first end section and a second end section, said housing structure further comprising a base and a cover extending between said first and second end sections, said substructure being located at said first end section, said section chamber section being located at said second end section, said vacuum pump inlet being located at said first end section and extending to a position such that said housing structure is adapted to be placed in use in two positions, one position with said first end section generally overlying said second end section and the other position wherein said first and second end sections are generally horizontally aligned.

8. Suction pump apparatus according to claim 7, wherein said base is provided with a continuously extending grooved region conforming in configuration with the peripherally extending edge of said cover and dimensioned to receive said edge when the cover is superimposed in seated relation upon said base.

9. Suction pump apparatus according to claim 4 wherein said vacuum pump inlet has an inlet end which extends to a position adjacent said cover such that when said housing structure is placed in said other position, said vacuum chamber can fill with aspirated fluid up to the level of said inlet end of said vacuum pump inlet.

10. Suction pump apparatus comprising a housing structure defining a vacuum chamber, an inlet to said vacuum chamber for receiving aspirated fluid, an outlet on said vacuum chamber for discharging said fluid, said housing structure defining a substructure sealed from said vacuum chamber, vacuum pump means within said substructure, said vacuum pump means having an inlet communicating with said vacuum chamber, said vacuum chamber having a first chamber section and a second chamber section, said second chamber section having a smaller volumetric capacity than said first chamber section, said vacuum chamber having a third chamber section separated from said second chamber section, said first chamber section being contiguous with said second and third chamber sections, said second chamber section being constructed and arranged to receive the aspirated fluid initially introduced into said vacuum chamber, whereby after said second chamber section becomes full with aspirated fluid, the continuing incoming aspirated fluid spills over to fill said third chamber section and after said third chamber section becomes full, the aspirated fluid begins to fill said first chamber section, thereby facilitating accurate measurement of small quantities of aspirated fluid initially introduced into said second chamber section.

11. Suction pump apparatus according to claim 10 further comprising indicia means on said third chamber section and on said first chamber section for indicating the volume of fluid therein.

12. Suction pump apparatus according to claim 10, wherein said vacuum pump comprises an electromagnetic coil and a diaphragm pump.

13. Suction pump apparatus according to claim 10 further comprising a baffle means juxtaposed to said inlet for directing incoming aspirating fluid to said second chamber section.

14. Suction pump apparatus according to claim 10 further comprising indicia on said second chamber section for indicating the volume of fluid in said second chamber section.

15. Suction pump apparatus according to claim 10 wherein said housing structure comprises a base member and a closure member superimposed on said base member to define said vacuum chamber therebetween.

16. Suction pump apparatus according to claim 10, wherein said closure member is formed of a transparent material to afford visual inspection of said vacuum chamber.

17. Suction pump apparatus according to claim 10, wherein said base member and said closure member are formed from plastic material.

* * * * *